US010412499B2

(12) United States Patent
Bhutani et al.

(10) Patent No.: US 10,412,499 B2
(45) Date of Patent: Sep. 10, 2019

(54) LOUDSPEAKER DRIVER/EXCITER WITH UNIQUE DESIGN TO FACILITATE MOUNTING

(71) Applicants: Harish Bhutani, Cerritos, CA (US); Gerardo Claustro, Azusa, CA (US)

(72) Inventors: Harish Bhutani, Cerritos, CA (US); Gerardo Claustro, Azusa, CA (US)

( * ) Notice: Subject to any disclaimer, the term of this patent is extended or adjusted under 35 U.S.C. 154(b) by 0 days.

(21) Appl. No.: 15/783,324

(22) Filed: Oct. 13, 2017

(65) Prior Publication Data

US 2019/0116426 A1 Apr. 18, 2019

(51) Int. Cl.
*H04R 25/00* (2006.01)
*H04R 9/06* (2006.01)
*H04R 9/04* (2006.01)

(52) U.S. Cl.
CPC ..... *H04R 9/063* (2013.01); *H04R 9/045* (2013.01)

(58) Field of Classification Search
CPC . H04R 1/028; H04R 9/06; H04R 7/06; H04R 9/045; H04R 1/02; H04R 7/10; H04R 7/045; H04R 2440/05; H04R 2499/13; H04R 7/04
See application file for complete search history.

(56) References Cited

U.S. PATENT DOCUMENTS

2005/0031155 A1* 2/2005 Bachmann ..... H04R 7/045 381/431
2013/0070955 A1* 3/2013 Holt ..... H04R 9/025 381/412
2013/0272563 A1* 10/2013 Boyd ..... H04R 1/00 381/406
2017/0287990 A1* 10/2017 Choi ..... G06F 1/1637

* cited by examiner

*Primary Examiner* — Amir H Etesam

(57) ABSTRACT

This invention is a loudspeaker driver/exciter assembly for use with a flat or slightly contoured surface panel to produce an audible sound. The invention is composed of a driver assembly, a frame, and a voice coil exciter assembly. The driver assembly includes magnet, core cap, and shell pot. The voice coil exciter assembly includes a former, coil and exciter assembly. A spider suspends the voice coil exciter assembly in relation to the driver assembly. The invention is mounted to the panel by one or more interfaces between the frame and the panel and one or more interfaces between the voice coil exciter assembly and the panel. One or more holes or apertures are provided in the shell pot, core cap, and magnet, and aligned with the screws or fasteners of the voice coil exciter assembly in such a way that a tool such as a screwdriver may be used to facilitate quick and easy mounting and removal of the driver/exciter assembly with the panel.

9 Claims, 2 Drawing Sheets

LOUDSPEAKER DRIVER/EXCITER WITH UNIQUE DESIGN TO FACILITATE MOUNTING

BACKGROUND

Loudspeaker driver/exciter assemblies today come in different configurations. Typically, the driver/exciter is coupled to a surface of a panel by the use of either bonding or mechanically fastening the frame of the assembly to the panel. In addition the movement of the exciter is transferred to the panel by bonding or mechanically fastening a vibration plate to the panel. If bonding is the method of mounting, then replacement of the driver/exciter assembly is nearly impossible and the entire panel may need to be replaced. If mechanically fastening is the method of mounting, then the driver/exciter is replaceable but there are usually 3 to 4 fasteners used for the frame and 3 to 4 fasteners used for the exciter to panel attachment. This use of multiple hardware fasteners leads to added weight in the system which in turn causes additional work for the moving features of the driver/exciter assembly.

SUMMARY OF THE INVENTION

The present invention of a loudspeaker driver/exciter assembly enables the installation and removal of the assembly quickly and with minimal hardware thus reducing weight and time for installation and removal. The loudspeaker driver/exciter assembly may include a support frame, shell pot, magnet, core cap, spider, coil and exciter pad. The assembly is uniquely designed with an access hole to allow mechanical attachment of both the support frame and the exciter pad to a panel with minimal hardware. The invention is designed to be attached to a panel or any such surface which is to be excited to produce an audible sound.

BRIEF DESCRIPTION OF THE DRAWINGS

The foregoing and other objects, features and advantages of the invention, will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
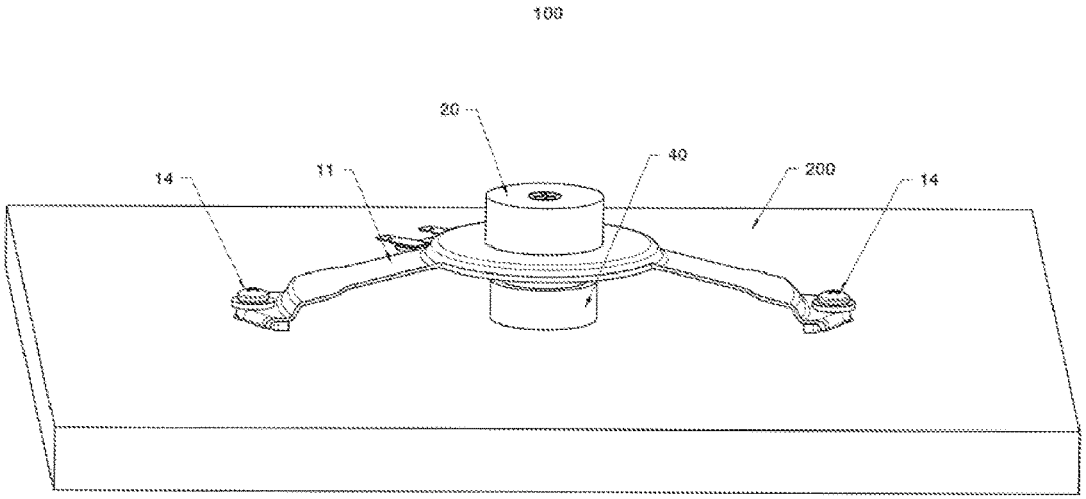
FIG. 1 is a perspective view of a driver/exciter assembly according to an embodiment of the present invention and an example of a method of the attachment to a thick panel.

FIG. 1 is an illustration of an embodiment of the present invention, a loudspeaker driver/exciter assembly 100, showing a rigid support frame 11 with two legs, a driver assembly 20 and a voice coil exciter assembly 40 with integral attach hardware 14 such as screws to attach both the frame 11 and the voice coil exciter assembly 40 to a panel 200, which panel is to be excited to produce an audible sound.

Figure 2:
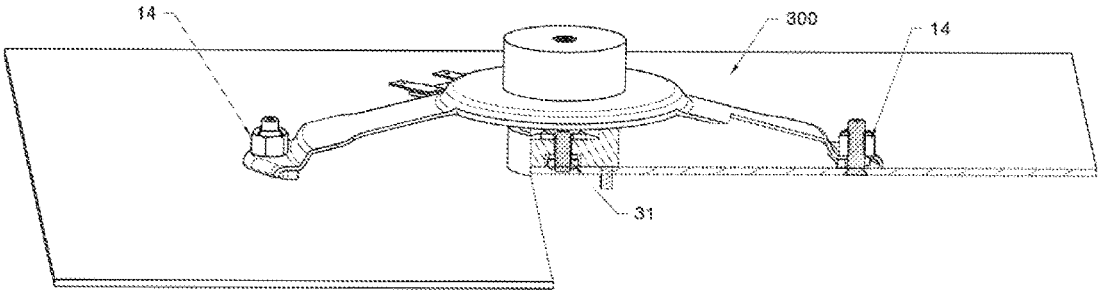
FIG. 2 is another example of a method of the attachment of the driver/exciter assembly to a thin panel.

FIG. 2 is an illustration of another embodiment of the present invention 100, mounted onto a thin metallic panel 300 by the use of attach hardware 14 and fasteners 31 that are pressed clinched into a metallic panel 300.

Figure 3:
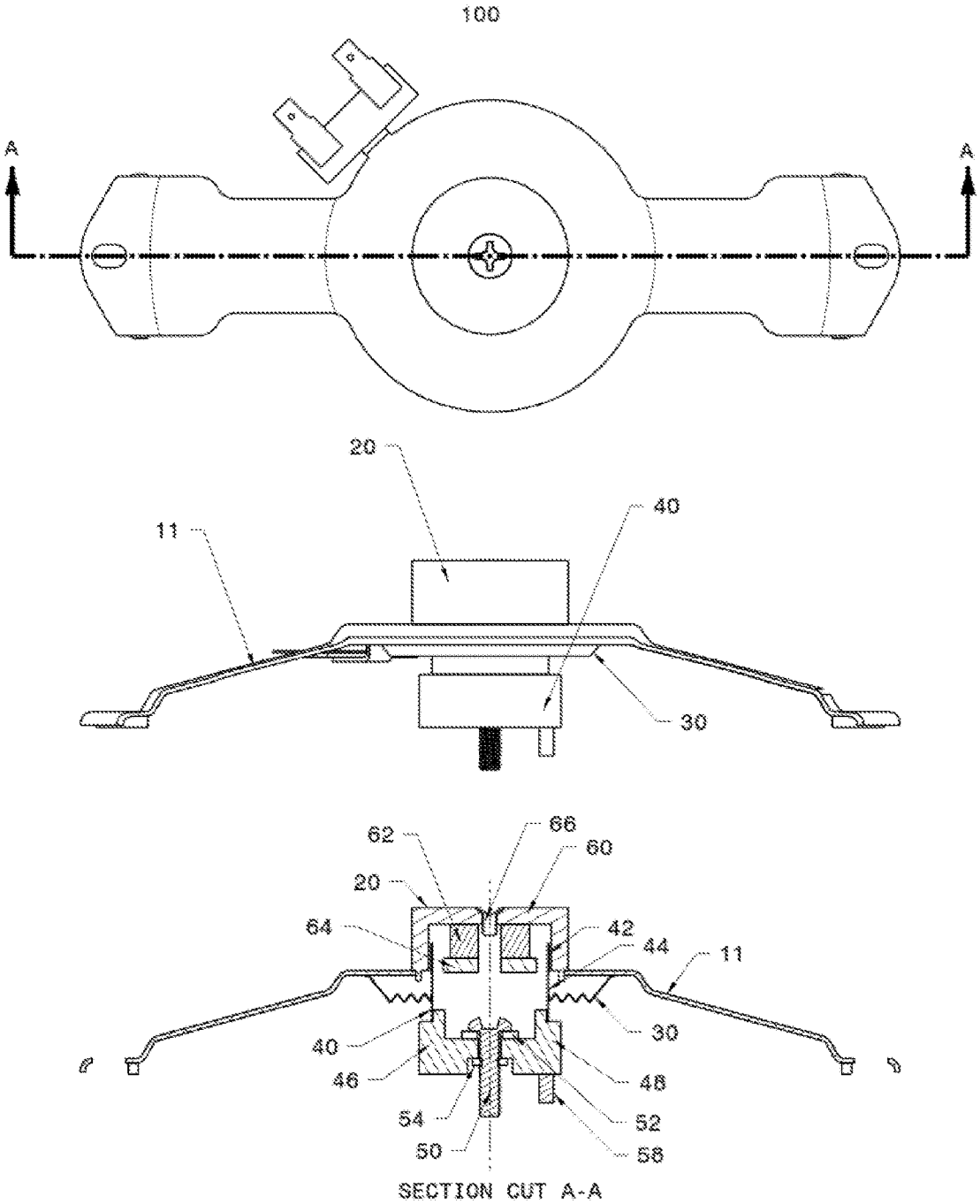
FIG. 3 is a top view, side view and cross-sectional cut of the driver/exciter assembly.

FIG. 3 is a top view, side view and section cut of the loudspeaker driver/exciter assembly 100. The loudspeaker driver/exciter may include a voice coil exciter assembly 40 and a driver assembly 20. In an embodiment, the driver assembly 20 consists of a shell pot 60 with center access hole that is installed into the support frame 11, a magnet 62 with center access hole, bonded to the shell pot 60 and a core cap 64 with center access hole bonded to the magnet 62. A screw 66 may be used to close out the access hole in the shell pot 60 to prevent foreign objects from entering the assembly. The voice coil exciter assembly 40 may include a coil 42, a former 44 and an exciter assembly 46. The exciter assembly 46 may include an exciter pad 48, attachment screw 50, washer 52 and a retaining clip 54. The exciter pad 48 has a centralized hole through which the attachment screw 50 extends, assembled with the washer 52 and retaining clip 54. The exciter pad 48 has a pin 58 feature that will be used as a clocking mechanism to insure the loudspeaker driver/exciter assembly is mounted onto the panel in one orientation only. The coil 42 and exciter pad 48 is bonded to the former 44. The voice coil exciter assembly 40 may be suspended and centered in relation to the driver assembly 20 by a spider 30. This spider 30 allows for the movement of the voice coil exciter assembly 40 which in turns creates movement in the surface of the panel 200, FIG. 1, by means of the exciter pad 48 mounted to the panel by the attachment screw 50. The alignment of the center access holes in the shell pot 60, magnet 62 and the core cap 64 is in line with the attachment screw of the exciter assembly 46 to allow a tool such as a screwdriver to be used to easily and quickly facilitate mounting and removal of the driver/exciter assembly to and from the panel.

While this invention has been particularly shown and described with references to preferred embodiments thereof, it will be understood by those skilled in the art that various changes in form and details may be made therein without departing from the scope of the invention encompassed by the appended claims.

The invention claimed is:

1. A loudspeaker exciter assembly for mounting to a panel or any such surface which is to be excited to produce an audible sound, featuring:

a screw or similar fastener assembled within and protruding from the loudspeaker exciter assembly, by means of which screw or fastener the exciter pad may be mounted to a panel to be excited; and an aperture extending through the loudspeaker exciter assembly to the head of said screw or fastener, enabling a tool such as a screwdriver to be inserted through the loudspeaker exciter assembly to access the screw or fastener in order to mount or unmount the loudspeaker exciter assembly to the panel.

2. A loudspeaker exciter assembly for mounting to a panel or any such surface which is to be excited to produce an audible sound, comprising:

a voice coil assembled onto a former;

an exciter pad attached to the former, featuring a hole or other aperture through the exciter pad;

a screw or similar fastener assembled within and protruding through the aperture of the exciter pad, by means of which screw or fastener the exciter pad may be mounted to a panel to be excited;

a driver assembly, consisting of a shell pot, a magnet, and a core cap, featuring an aperture enabling a tool such as a screwdriver to be inserted through the driver assembly to access the screw or fastener located in the exciter pad;

a frame, supporting the driver assembly in or near its center, featuring legs by which the loudspeaker exciter assembly is mounted to a panel; and a spider attached to the frame and to the voice coil assembly suspending and positioning the voice coil in relation to the magnet assembly.

3. The loudspeaker exciter assembly of claim 2 which further a screw assembled into the aperture of the shell pot to protect foreign objects from entering the assembly.

4. The loudspeaker exciter assembly of claim 2 which further includes said screw or similar fastener assembled to the said exciter pad with a washer and retaining clip or similar device.

5. The loudspeaker exciter assembly of claim 2 which further includes the said exciter pad featuring a pin or similar feature which serves as a mechanism to ensure that the loudspeaker exciter assembly is installed in one orientation only.

6. The loudspeaker exciter assembly of claim 2 which further Includes the said exciter pad attached to said former by bonding the exciter pad to the inside surface of the former.

7. The loudspeaker exciter assembly of claim 2 which further includes hardware such as screws to assemble the legs of the frame to a panel.

8. The loudspeaker exciter assembly of claim 2 which further includes attachment hardware to assemble the legs of the frame with fasteners that are press clinched into a thin metallic panel.

9. A method of mounting a loudspeaker exciter assembly onto a panel, or onto any such surface which is to be excited, by inserting a tool such as a screwdriver through an aperture or access hole of the loudspeaker exciter assembly in order to access a fastener, such as a screw, which is integral to the loudspeaker exciter assembly, and manipulating the fastener with the tool in order to couple the loudspeaker exciter assembly with the panel.

* * * * *